US006842099B2

(12) United States Patent
Betz et al.

(10) Patent No.: US 6,842,099 B2
(45) Date of Patent: Jan. 11, 2005

(54) ROD COIL FOR IGNITION SYSTEMS

(75) Inventors: Dieter Betz, Vaihingen (DE); Wolfram Schoellig, Stuttgart (DE); Klaus Lerchenmueller, Immenstadt (DE); Wolfgang Gaede, Marbach (DE); Christian Hauer, Remshalden (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/433,522

(22) PCT Filed: Oct. 21, 2002

(86) PCT No.: PCT/DE02/03963

§ 371 (c)(1),
(2), (4) Date: Nov. 13, 2003

(87) PCT Pub. No.: WO03/038959

PCT Pub. Date: May 8, 2003

(65) Prior Publication Data

US 2004/0075517 A1 Apr. 22, 2004

(30) Foreign Application Priority Data

Oct. 23, 2001 (DE) ..... 101 52 177

(51) Int. Cl.[7] ..... H01F 22/02
(52) U.S. Cl. ..... 336/96; 336/90; 336/92
(58) Field of Search ..... 336/90, 92, 96

(56) References Cited

U.S. PATENT DOCUMENTS 6,045,648 A * 4/2000 Palmgren et al. ..... 156/272.4
6,114,935 A 9/2000 Oosuka et al.
6,191,675 B1 * 2/2001 Sudo et al. ..... 336/96
6,252,483 B1 * 6/2001 Kawano et al. ..... 336/189
6,368,434 B1 * 4/2002 Espagnacq et al. ..... 149/108.6
6,426,032 B1 * 7/2002 Osuka et al. ..... 264/328.9
6,474,322 B1 * 11/2002 Ubukata et al. ..... 123/634
2002/0011910 A1 * 1/2002 Shimoide et al. ..... 336/90
2003/0128090 A1 * 7/2003 Paul et al. ..... 336/96

FOREIGN PATENT DOCUMENTS

| | | |
|---|---|---|
| DE | 196 23 399 | 1/1998 |
| DE | 197 02 438 | 8/1998 |
| DE | 199 27 820 | 7/2000 |
| DE | 199 62 279 | 7/2000 |
| EP | 0 827 163 | 3/1998 |

* cited by examiner

*Primary Examiner*—Anh Mai
(74) *Attorney, Agent, or Firm*—Kenyon & Kenyon

(57) ABSTRACT

A rod coil (11) for ignition systems, in particular in the form of an ignition coil in internal combustion engines of motor vehicles, designed for long-term serviceability.

The rod coil (11) has a centrally located core (14) as the internal magnetic iron core and, on a housing (13), a yoke (18) made of plastic as the external magnetic iron core. To avoid partial electrical discharges on the rod coil (11), a fill body (22) is provided between the yoke (18) and housing (13) thereby forming an inner, gap-free bond between the yoke (18) and housing (13).

12 Claims, 1 Drawing Sheet

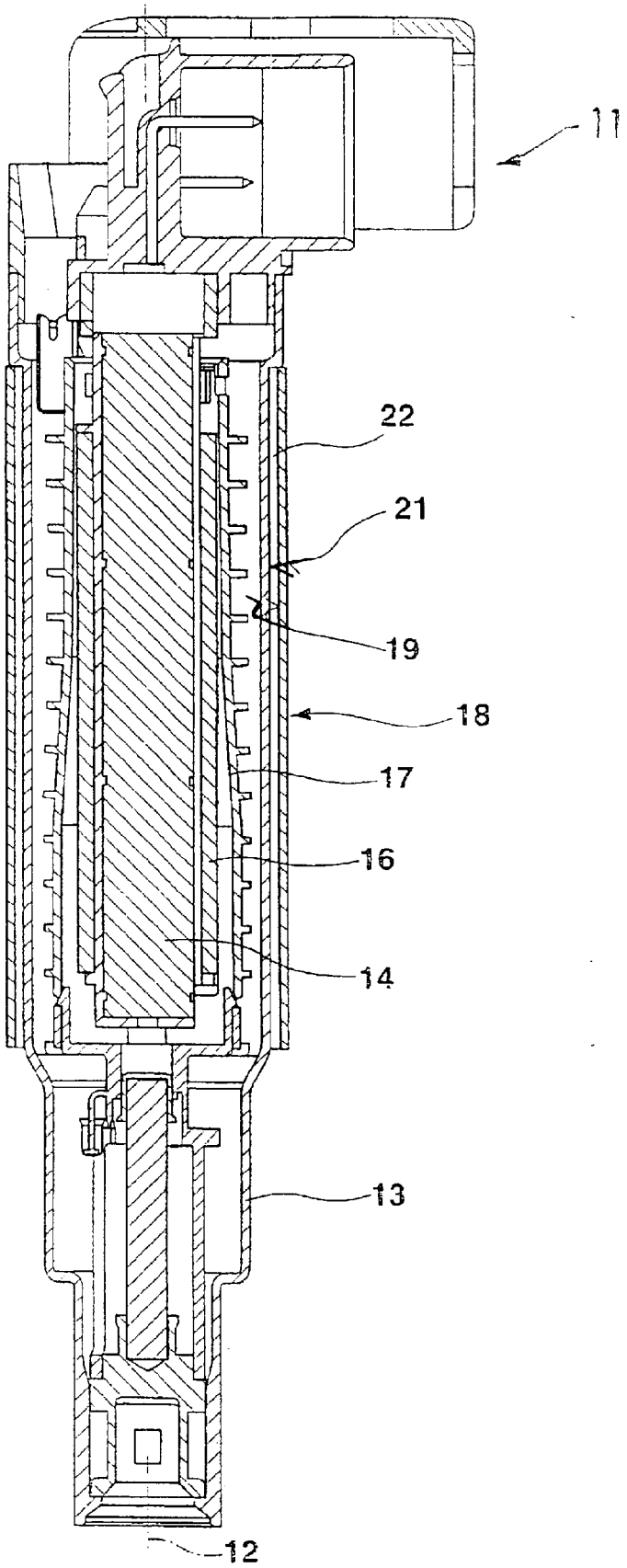
11
22
21
19
18
17
16
14
13
12

ROD COIL FOR IGNITION SYSTEMS

BACKGROUND INFORMATION

The present invention is directed to a rod coil for ignition systems, in particular in the form of an ignition coil in internal combustion engines of motor vehicles according to the definition of the species in claim 1.

A rod coil having a cylindrical housing in the basic form is known from German Patent 196 23 399 C2. A rod-shaped core of an open magnetic circuit is centrally located in the housing and within a winding set. To control the magnetic field, the winding set is concentrically surrounded by a sleeve-shaped slotted yoke mounted on an inner wall or, alternatively, on an outer wall of the housing, an insulator being inserted in between. The purpose of this yoke is to close the magnetic field of the rod coil.

Due to unavoidable, production-related dimensional inaccuracies in the yoke and housing, air-filled cavities are produced between the two bodies when the yoke comes to rest against the housing. Partial electrical discharges that, over the long term, cause deterioration of the rod coil insulation through material wear, possibly resulting in coil failure, occur at these voids during rod coil operation.

ADVANTAGES OF THE INVENTION

The rod coil for ignition systems according to the present invention, having the characterizing features of claim 1, has the advantage that it avoids the inadequacy mentioned above. For this purpose, the rod coil is designed so that a fill body is positioned between the yoke and housing. This fill body causes the housing to rest snugly without gaps against the yoke so that no partial electrical discharges occur during rod coil operation, and the rod coil is protected against failure due to deterioration of its insulation.

Advantageous refinements for implementing the present invention are specified in the subordinate claims.

DRAWING

One exemplary embodiment of the present invention is illustrated in the drawing and explained in greater detail in the description of the FIGURE. The sole figure shows a longitudinal section of the rod coil in which the dimensions of a fill body between a yoke and housing of the rod coil are enlarged to improve visual clarity.

DESCRIPTION OF THE EXEMPLARY EMBODIMENT

A rod coil 11 for ignition systems according to the figure, in particular in the form of an ignition coil in internal combustion engines of motor vehicles, is provided for direct contacting with a spark plug, which is inserted in the usual manner into a shaft in the cylinder head of an internal combustion engine and is not illustrated in further detail here.

Rod coil 11 includes a longitudinal cylindrical core 14 made of plastic that is positioned coaxially to a longitudinal axis 12 in a housing 13 and is also known as the I core. Core 14 is made of a coated magnetizable material and is part of an open magnetic circuit. Located concentrically around core 14 is an internally mounted, low-voltage-conducting primary winding 16 and an externally mounted high-voltageconducting secondary winding 17.

To control the magnetic field of rod coil 11, windings 16, 17 are surrounded by a yoke 18 that is made of a magnetizable material and is mounted on an inner wall 19 of housing 13. Alternatively, yoke 18 is also mountable on an outer wall 21 of housing 13. Yoke 18 is slotted parallel to longitudinal axis 12 to prevent a short circuit of the magnetic field.

A fill body 22 is provided between yoke 18 and housing 13—between yoke 18 and outer wall 21 of housing 13 in the exemplary embodiment illustrated here. This fill body 22 may be designed a s a hot-melt adhesive and be made, for example, of polyolefin, polyamide or a silicone-based material.

Fill body 22 may also be in the form of an epoxy resin coating that may be both electrically conductive and electrically insulating and is attached to housing 13 or yoke 18.

In the case of a yoke 18 surrounding housing 13, fill body 22 is alternatively mountable on outer wall 21 of housing 13, in particular if fill body 22 is in the form of a heat-shrinkable sleeve.

In any case, fill body 22 makes it possible to establish an inner, gap-free bond between yoke 18 and housing 13. The avoidance of cavities between yoke 18 and housing 13 prevents partial electrical discharges from occurring on rod coil 11 during the operation thereof. This prevents rod coil 11 from failing due to deterioration of its insulation.

What is claimed is:

1. A rod coil for an ignition system comprising:

a hollow cylindrical housing;

a core centrally situated in the housing as an internal magnetic iron core;

a yoke mounted on the housing as an external magnetic iron core; and a fill body situated between the housing and the yoke.

2. The rod coil according to claim 1, wherein the fill body is mounted on an inner wall of the housing.

3. The rod coil according to claim 1, wherein the rod coil is an ignition coil in an internal combustion engine of a motor vehicle.

4. The rod coil according to claim 1, wherein the fill body is mounted on an outer wall of the housing.

5. The rod coil according to claim 4, wherein the fill body includes a heatshrinkable sleeve that is mounted on the outer wall of the housing.

6. The rod coil according to claim 1, wherein the fill body includes an epoxy resin coating.

7. The rod coil according to claim 6, wherein the epoxy resin coating is electrically conductive.

8. The rod coil according to claim wherein the epoxy resin coating is electrically insulating.

9. The rod coil according to claim 1, wherein the fill body includes a hot-melt adhesive.

10. The rod coil according to claim 9, wherein the adhesive is composed of polyolefin.

11. The rod coil according to claim 9, wherein the adhesive is composed of polyamide.

12. The rod coil according to claim 9, wherein the adhesive is silicone-based.

* * * * *

UNITED STATES PATENT AND TRADEMARK OFFICE

CERTIFICATE OF CORRECTION

PATENT NO. : 6,842,099 B2
DATED : January 11, 2005
INVENTOR(S) : Dieter Betz et al.

It is certified that error appears in the above-identified patent and that said Letters Patent is hereby corrected as shown below:

Title page,
Item [57], ABSTRACT,
Line 1, delete "(11)".
Lines 3-4, change "long-term serviceability. The rod coil." to -- long-term serviceability. The rod coil --.
Line 4, delete "(11) (14)".
Line 5, delete "(13)".
Line 6, delete "(18)".
Line 7, delete "(11)".
Line 8, delete "(22) (18)".
Line 9, delete "(13)".
Line 10, delete "(18) (13)".

Column 1,
Line 3, insert heading -- Field of the Invention --.
Line 4, insert -- The present invention is directed to a rod coil for ignition systems, in particular in the form of an ignition coil in internal combustion engines of motor vehicles. --.
Line 5, delete "The present . . . in claim 1.".
Line 11, change "Patent 196 23 399 C2." to -- Patent No. 196 23 399. --.
Line 27, change "Advantages of the Invention" to -- Summary of the Invention --.
Line 29, change "invention, having the characterizing features of claim 1, has" to -- invention has --.
Lines 38-39, delete "Advantageous ... subordinate claims".
Line 41, change "Drawing" to -- Brief Description of the Drawing --.
Lines 42-44, delete "One exemplary ... of the Figure."
Line 44, change "The sole figure shows" to -- The Figure shows --.
Lines 50-51, change "Description of the Exemplary Embodiment" to -- Detailed Description --.

UNITED STATES PATENT AND TRADEMARK OFFICE

CERTIFICATE OF CORRECTION

PATENT NO. : 6,842,099 B2
DATED : January 11, 2005
INVENTOR(S) : Dieter Betz et al.

It is certified that error appears in the above-identified patent and that said Letters Patent is hereby corrected as shown below:

Column 1 (cont'd),
Line 52, change "according to the figure," to -- according to the Figure, --.

Signed and Sealed this

Sixteenth Day of August, 2005

JON W. DUDAS
*Director of the United States Patent and Trademark Office*